US011808445B1

(12) United States Patent
He

(10) Patent No.: US 11,808,445 B1
(45) Date of Patent: Nov. 7, 2023

(54) LIGHTING ASSEMBLY

(71) Applicant: Minyi He, Guangzhou (CN)

(72) Inventor: Minyi He, Guangzhou (CN)

(73) Assignee: Minyi He, Guangzhou (CN)

( * ) Notice: Subject to any disclaimer, the term of this patent is extended or adjusted under 35 U.S.C. 154(b) by 0 days.

(21) Appl. No.: 18/190,817

(22) Filed: Mar. 27, 2023

(51) Int. Cl.

| | |
|---|---|
| ***F21V 33/00*** | (2006.01) |
| ***F21V 23/04*** | (2006.01) |
| ***F21V 23/00*** | (2015.01) |
| ***A43B 3/36*** | (2022.01) |

(52) U.S. Cl.
CPC ..... *F21V 33/0008* (2013.01); *A43B 3/36* (2022.01); *F21V 23/009* (2013.01); *F21V 23/0407* (2013.01)

(58) Field of Classification Search
CPC ..... F21V 33/0008; F21V 23/009; F21V 23/0407; A43B 3/36
See application file for complete search history.

(56) References Cited

U.S. PATENT DOCUMENTS 5,473,518 A * 12/1995 Haber ..... A43B 3/36 36/137
10,897,949 B1 * 1/2021 Hakopyan ..... A43B 3/36
2004/0100792 A1 * 5/2004 Trzecieski ..... A63C 3/00 36/137
2016/0091186 A1 * 3/2016 Chow ..... A43B 3/38 362/103
2021/0298406 A1 * 9/2021 Twombly ..... A43B 1/0054

FOREIGN PATENT DOCUMENTS

CN 102418889 A 4/2012
CN 208703891 U 4/2019
CN 217904696 U 11/2022

* cited by examiner

*Primary Examiner* — Thomas M Sember
(74) *Attorney, Agent, or Firm* — Nitin Kaushik

(57) ABSTRACT

The present disclosure relates to a lighting assembly including a lighting structure. The lighting structure includes a protective housing, a wick, and a main control circuit board; the surface of the main control circuit board is provided with a lighting module structure for switching the modes of ever-bright lighting, flickering lighting, and low-speed flickering lighting; when a switching button is in contact with the surface of a contact conductor, a loop is formed to respectively switch the modes of ever-bright lighting, flickering lighting, and low-speed flickering lighting in the lighting module structure so as to improve the practicality of a product; different modes can be used in different lighting occasions; flickering lighting can be selected to increase the promptness thereof on foggy days so as to ensure personal safety; low-speed flickering lighting can be selected in rainy days so as to achieve the function of reducing power consumption.

10 Claims, 7 Drawing Sheets

LIGHTING ASSEMBLY

TECHNICAL FIELD

The present disclosure relates to the technical field of lighting shoes, and more particularly to a lighting assembly.

BACKGROUND

Shoes are one of the indispensable daily necessities in daily life. People need to take a flashlight when walking at night, which brings a lot of inconvenience to people walking at night. When walking at night in a dark environment, people can easily step into a puddle or other dangerous road sections. When specific populations work and travel, such as fieldwork or exploration, and outdoor tourism, they are easy to get hurt when walking in a dim and poorly lit environment; or sudden power failure without emergency lighting equipment will cause great trouble and risk to an action. The existing pathfinding lighting shoes can help a user to illuminate, but the function of the lighting equipment is relatively single and does not have the function of switching modes; different patterns are required to achieve different lighting effects when on foggy, rainy, and cloudy days. Therefore, there is an urgent need in the market to develop a pathfinding lighting shoe to help people solve existing problems.

In the prior art, reference can be made to the Chinese patent with the publication number CN211186022U3, which discloses a pathfinding lighting shoe, relating to the field of pathfinding shoes, and aims at solving the problems that existing pathfinding shoe lighting equipment in the prior art is inconvenient to install and not suitable for wide crowds. A shoe tongue is arranged on one side of the pathfinding shoe; an anti-abrasion pad is arranged on the other side of the pathfinding shoe; heels are arranged below the pathfinding shoes; a rear illuminating lamp is mounted to one side of the heel; a front illuminating lamp is mounted below the shoe tongue; a sole is arranged below the pathfinding shoe; a storage battery is mounted in the sole; anti-skidding protruding blocks are arranged on the lower end face of the sole. Magic tapes are mounted outside the shoe tongues; an insole is arranged in the pathfinding shoe, a heel soft cushion is arranged on one side of the insole, a shock absorption cushion layer is arranged on the upper end face of the shoe sole, a wire is installed on one side of a storage battery, a fastening screw is installed outside the heel, a photoelectric switch is arranged on the front end face of a front illuminating lamp, and a floodlight is installed in the front illuminating lamp.

Although the patent has the effect of lighting, the function of the lighting equipment is relatively single and the function of switching modes is not provided; when on foggy, rainy, and cloudy days, different modes are required to achieve different lighting effects so as to ensure the progress of work and personal safety, and when in use, its structure needs to be further processed and improved which increases the process and reduces the working efficiency. Therefore, the present inventors propose a lighting assembly to solve the above-mentioned technical problem of realizing different modes to achieve different lighting effects on foggy, rainy, and cloudy days.

SUMMARY

In order to overcome the above shortcomings, the disclosure aims at providing a technical solution that can solve the above problems.

A lighting assembly comprising a lighting structure is disclosed; the lighting structure comprises a protective housing, a wick, and a main control circuit board; the main control circuit board is mounted inside the protective housing, the wick is electrically connected to the main control circuit board, a power line is provided on a surface of the main control circuit board, and a connecting rod is mounted to one end of the protective housing;

the surface of the main control circuit board is mounted with a lighting module structure for switching modes of ever-bright lighting, flickering lighting, and low-speed flickering lighting, one end of the protective housing is mounted with a switching button for switching modes, and the switching button is electrically connected to the main control circuit board.

Further, the surface of the shoe body is provided with a mounting hole matchingly mounted with a connecting rod, the mounting hole and the protective housing are of a detachable structure, the mounting hole is in a curved array on the surface of the shoe body, one end of the mounting hole penetrates a middle of the shoe body and extends to an inside of the shoe body, the bottom of the shoe body is a sole plate, the mounting hole extends between the shoe body and the sole plate, the surface of the connecting rod is provided with a limiting assembly for matching with the mounting hole, and the limiting assembly comprises an upper press plate and a lower press plate.

Further, the lighting module structure comprises an ever-bright lighting assembly. The ever-bright lighting assembly is composed of an ever-bright lighting module, one end of the ever-bright lighting module abuts against one end of the power line, the ever-bright lighting module is electrically connected to the main control circuit board, and when the switching button is in contact with one end of the main control circuit board, a loop is formed by the main control circuit board and the ever-bright lighting module and the power line, so that the ever-bright lighting module is powered on to operate, thereby achieving the effect of ever-bright lighting.

Further, the lighting module structure comprises a flickering lighting assembly. The flickering lighting assembly is composed of a flickering lighting module, one end of the flickering lighting module abuts one end of the power line, the flickering lighting module is electrically connected to the main control circuit board, and when the switching button is in contact with one end of the main control circuit board, a loop is formed by the main control circuit board and the flickering lighting module and the power line, so that the flickering lighting module is powered on to operate, thereby achieving the effect of flickering lighting.

Further, the lighting module structure comprises a low-speed flickering lighting assembly. The low-speed flickering lighting is composed of a low-speed flickering lighting module, one end of the low-speed flickering lighting module abuts one end of the power line, the low-speed flickering lighting module is electrically connected to the main control circuit board, and when the switching button is in contact with one end of the main control circuit board, a loop is formed by the main control circuit board and the low-speed flickering lighting module and the power line, so that the low-speed flickering lighting module is powered on to operate, thereby achieving the effect of low-speed flickering lighting.

Further, the outside of the switching button is provided with a protective flexible glue, and a contact conductor is connected to the surface of the main control circuit board; the contact conductor is in contact with one end of the power line; the power line is used for connecting to the lighting module structure; when one end of the switching button is in contact with the surface of the contact conductor, a loop is formed so as to realize switching modes of ever-bright lighting, flickering lighting, and low-speed flickering lighting in the lighting module structure respectively; the modes of ever-bright lighting, flickering lighting, and low-speed flickering lighting are all powered on via the power line.

Further, the upper press plate and the lower press plate are symmetrically mounted to the surface of the connecting rod in the structure, one end of the upper press plate and one end of the lower press plate are both arc-shaped, the surfaces of the upper press plate and the lower press plate are both provided with a mounting groove, the inner surface of the mounting groove is connected with a press cake for increasing the connection stability, the middle part of the press cake is provided with a press groove, the press cake is in concave-shaped, one end of the press cake is higher than the inner surface of the mounting groove and extends beyond the surface of the upper press plate or the lower press plate, and the outer side face of the press cake is used for fitting with the inner surface of the press groove;

when the connecting rod penetrates into the mounting hole to reach the inside of the shoe body, the gap formed between the upper press plate and the lower press plate clamps the surface of the shoe body, and the gap formed between the upper press plate and the lower press plate is further reduced by the press cake mounted between the upper press plate and the lower press plate, thereby achieving the function of a compression space, increasing the pressure caused to the surface of the shoe body between the upper press plate and the lower press plate, and increasing the clamping force and reducing the possibility of the connecting rod disengaging from the mounting hole.

The surfaces of the upper press plate and the lower press plate are both provided with a diversion trench for assisting in drainage, the diversion trenches are linearly arranged on the outer side faces of the upper press plate and the lower press plate, and the two adjacent diversion trenches are equidistantly arranged therebetween; when a liquid adheres to the surfaces of the upper press plate or the lower press plate, the diversion trenches serve the function of guiding the liquid so as to facilitate the liquid to drain out of the surfaces of the upper press plate or the lower press plate, so as to reduce the time for the liquid to stagnate on the surfaces of the upper press plate or the lower press plate, and reduce the phenomena that the liquid stagnates for too long and causes corrosion on the surfaces of the upper press plate or the lower press plate.

Further, one end of the shoe body is a limiting block for defining the position of an ankle; a movable sling is connected to the surface of the shoe body; the movable sling is rotatably mounted to the surface of the shoe body; the movable sling plays the role of tightening the shoe body; the surface of the movable sling is provided with anti-skid stripe; one end of the sole plate is provided with a cushioning pad for cushioning the impact force; the surface of the shoe body is provided with several drainage grooves for assisting in the drainage; when the interior of the shoe body permeates liquid, the liquid is discharged to the exterior of the shoe body through the drainage grooves; the anti-skid stripe serves to increase a contact point between the surface of the movable sling and the user's hand, thereby serving to increase a frictional force to reduce slippage of the user's hand on the surface of the movable sling.

Further, a cover plate is mounted at one end of the protective housing, the cover plate is used for protecting a battery mounted inside the protective housing, the type of the battery is a button battery, a movable rotating shaft is connected to one end of the cover plate, and the cover plate can move along the surface of the protective housing via the movable rotating shaft;

when an acting force is applied to the cover plate, the cover plate rotates along the surface of the protective housing via a movable rotating shaft, so that a user can put a battery into the interior of the protective housing, enabling the main control circuit board to continuously supply power to the wick; one end of the protective housing is a protective plate, and the protective plate is symmetrically mounted at two ends of the protective housing; the wick is located between two adjacent protective plates, and the protective plate is used for protecting the wick.

Further, a connecting hole is provided on the surface of the protective plate, a cushioning rubber block is connected to the inner surface of the connecting hole, the cushioning rubber block abuts against the surface of the protective plate via the connecting hole, the cushioning rubber block is used for cushioning the impact force so as to have the effect of protecting the surface of the protective plate, one end of the protective plate is provided with a frosted layer for increasing the frictional force, and the frosted layer is used for increasing the contact area between the surface of the protective plate and the hand of the user so as to play the role of increasing the frictional force, achieve the effect of reducing the sliding of the hand of the user on the surface of the protective plate, and facilitate the user to conveniently mount or disassemble the protective plate;

a through-hole is provided on the surface of the main control circuit board, the through-hole is rectangularly distributed on the surface of the main control circuit board, the through-hole is used for connecting an external screw, a locking force is generated by the external screw to enable the main control circuit board to be mounted inside the protective housing, an anti-skid groove is provided on the surface of the protective housing, and the anti-skid groove is used for increasing the contact point between the surface of the protective housing and the user's hand, thereby playing the role of increasing frictional force and achieving the effect of reducing the sliding of the user's hand on the surface of the protective housing.

Compared to the prior art, the advantageous effects of the present disclosure are as follows: the switching button is used to make contact with the surface of the contact conductor so as to form a loop to respectively switch the modes of ever-bright lighting, flickering lighting, low-speed flickering lighting, or projection in the lighting module structure, thereby improving the practicality of the product; different modes can be used in different lighting occasions; flickering lighting can be selected to increase the promptness thereof in foggy days so as to ensure personal safety; low-speed flickering lighting can be selected in rainy days so as to achieve the function of reducing power consumption; the ever-bright mode can be selected on cloudy days to ensure the visibility.

Figure 1:
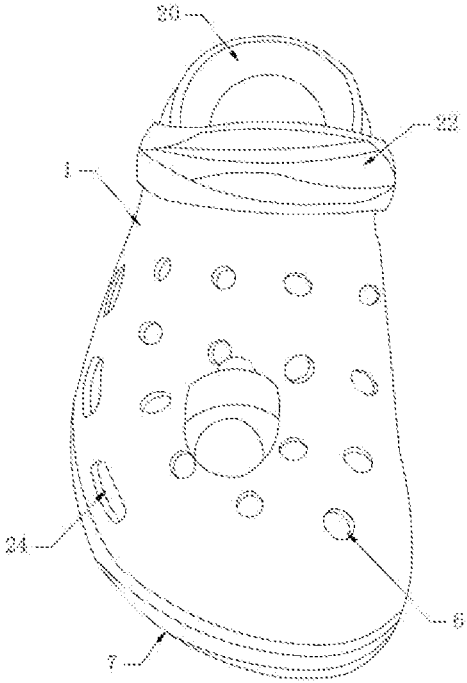
FIG. 1 is a perspective view of a lighting assembly.

In the drawings: 1—shoe body, 2—protective housing, 3—wick, 4—main control circuit board, 5—connecting rod, 6—mounting hole, 7—sole plate, 8—power line, 9—upper press plate, 10—lower press plate, 11—ever-bright lighting module, 12—flickering lighting module, 13—low-speed flickering lighting module, 14—switching button, 15—protective flexible glue, 16—contact conductor, 17—mounting groove, 18—press cake, 19—press groove, 20—limiting block, 21—movable sling, 22—anti-skid stripe, 23—cushioning pad, 24—drainage groove, 25—cover plate, 26—movable rotating shaft, 27—protective plate, 28—connecting hole, 29—cushioning rubber block, 30—frosted layer, 31—through-hole, 32—anti-skid groove, and 33—diversion trench.

DETAILED DESCRIPTION OF THE EMBODIMENTS

The present disclosure will be further described in detail below with reference to the accompanying drawings and specific implementation modes.

Embodiment 1

Figure 2:
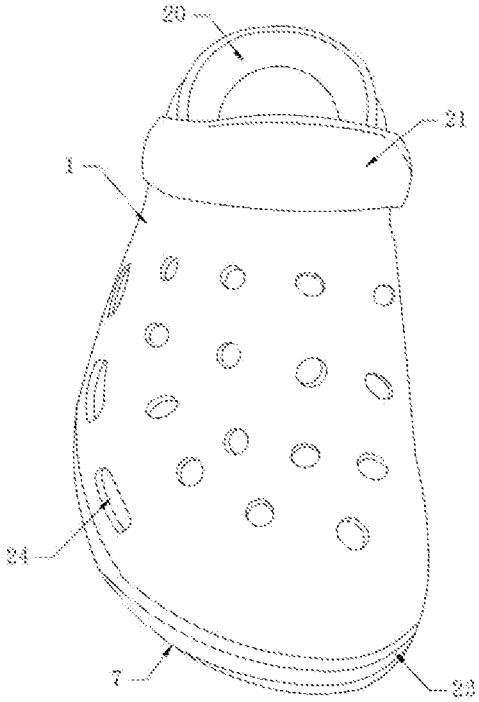
FIG. 2 is a perspective view of a shoe body in a lighting assembly.
Figure 3:
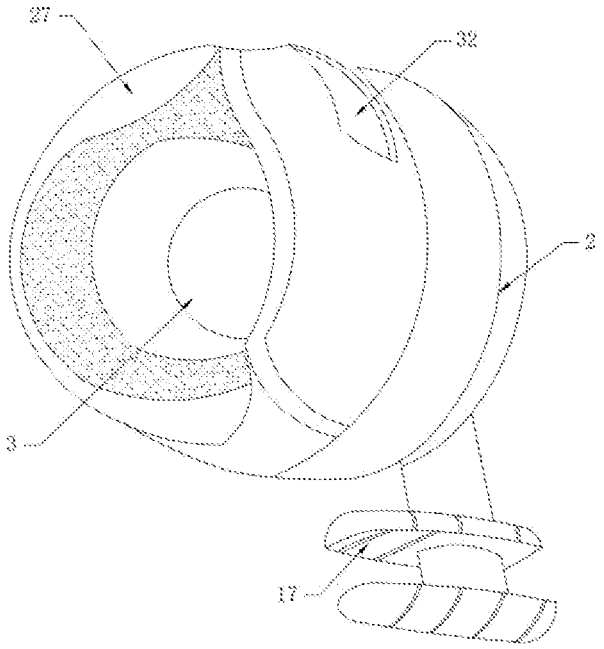
FIG. 3 is a perspective view of a lighting structure in a lighting assembly.
Figure 4:
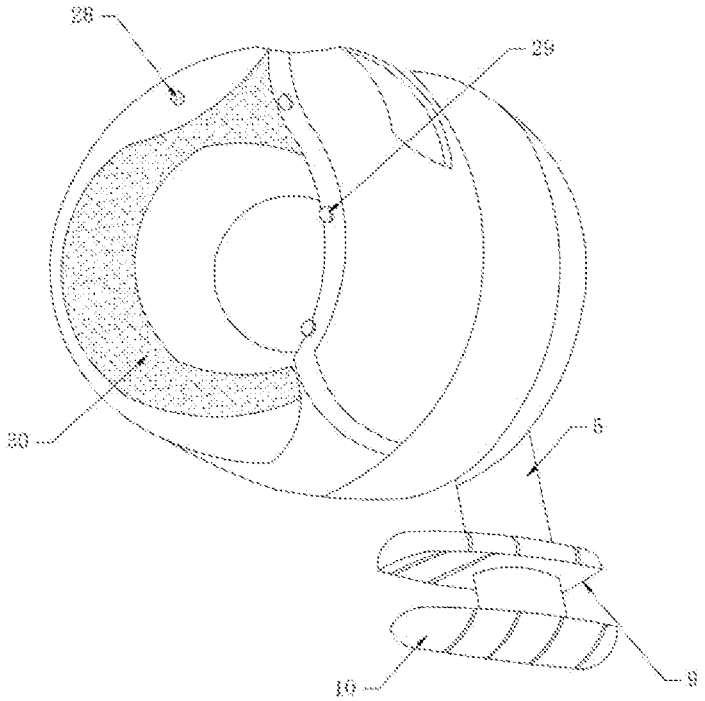
FIG. 4 is another perspective view of a lighting structure in a lighting assembly.
Figure 5:
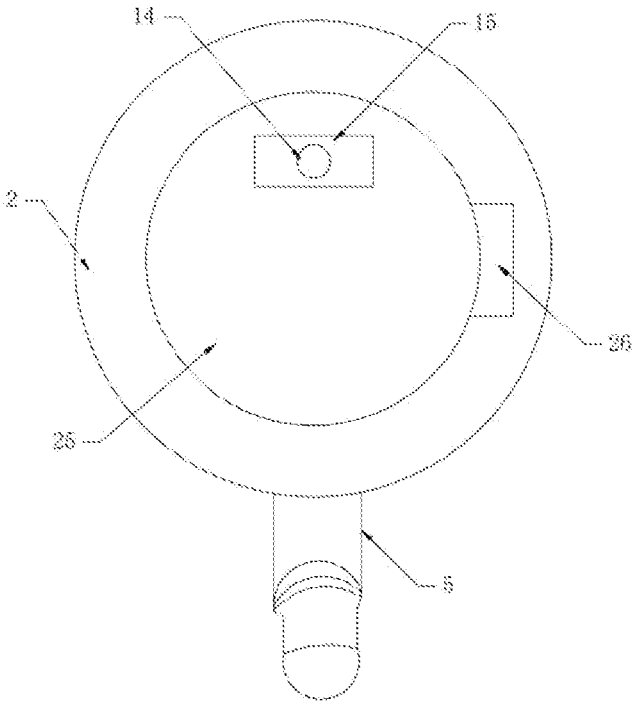
FIG. 5 is a rear view of a lighting structure in a lighting assembly.
Figure 6:
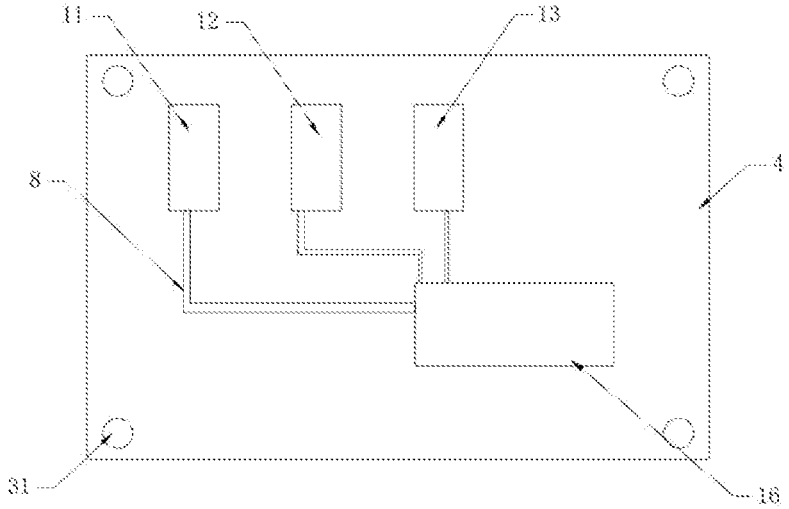
FIG. 6 is a front view of a main control circuit board in a lighting assembly.
Figure 7:
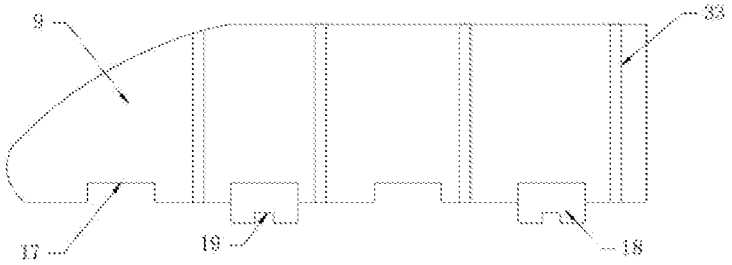
FIG. 7 is a front view of a limiting assembly in a lighting assembly.

In this embodiment, with reference to FIGS. 1-7, a specifically implemented lighting assembly comprises a shoe body 1 and a lighting structure. The lighting structure comprises a protective housing 2, a wick 3, and a main control circuit board 4. The main control circuit board 4 is mounted inside the protective housing 2, the wick 3 and the main control circuit board 4 are electrically connected, a power line 8 is provided on the surface of the main control circuit board 4, a connecting rod 5 is mounted to one end of the protective housing 2, a mounting hole 6 matchingly mounted with the connecting rod 5 is provided on the surface of the shoe body 1, the mounting hole 6 and the protective housing 2 are of a detachable structure, and the mounting hole 6 is in a curved array on the surface of the shoe body 1. One end of the mounting hole 6 penetrates through the middle of the shoe body 1 and extends towards the interior of the shoe body 1, the bottom of the shoe body 1 is a sole plate 7, and the mounting hole 6 extends between the shoe body 1 and the sole plate 7.

The surface of the main control circuit board 4 is mounted with a lighting module structure for switching the modes of ever-bright lighting, flickering lighting, low-speed flickering lighting, or projection; the surface of the connecting rod 5 is provided with a limiting assembly matched with the mounting hole 6; the limiting assembly comprises an upper press plate 9 and a lower press plate 10; one end of the protective housing 2 is mounted with a switching button 14 for switching modes; the switching button 14 is electrically connected to the main control circuit board 4.

The lighting module structure comprises an ever-bright lighting assembly. The ever-bright lighting assembly is composed of an ever-bright lighting module 11, one end of the ever-bright lighting module 11 abuts against one end of the power line 8, the ever-bright lighting module 11 is electrically connected to the main control circuit board 4, and when the switching button 14 is in contact with one end of the main control circuit board 4, a loop is formed by the main control circuit board 4 and the ever-bright lighting module 11 and the power line 8, so that the ever-bright lighting module 11 is powered on to operate, thereby achieving the effect of ever-bright lighting.

The outside of the switching button 14 is provided with a protective flexible glue 15, and a contact conductor 16 is connected to the surface of the main control circuit board 4; the contact conductor 16 is in contact with one end of the power line 8; the power line 8 is used for connecting to the lighting module structure; when one end of the switching button 14 is in contact with the surface of the contact conductor 16, a loop is formed so as to switch the mode in the lighting module structure; the mode of ever-bright lighting is powered on via the power line 8.

The upper press plate 9 and the lower press plate 10 are symmetrically mounted to the surface of the connecting rod 5 in the structure, one end of the upper press plate 9 and one end of the lower press plate 10 are both arc-shaped, the surfaces of the upper press plate 9 and the lower press plate 10 are both provided with a mounting groove 17, the inner surface of the mounting groove 17 is connected with a press cake 18 for increasing the connection stability, the middle part of the press cake 18 is provided with a press groove 19, the press cake 18 is in concave-shaped, one end of the press cake 18 is higher than the inner surface of the mounting groove 17 and extends beyond the surface of the upper press plate 9 or the lower press plate 10, and the outer side face of the press cake 18 is used for fitting with the inner surface of the press groove 19;

when the connecting rod 5 penetrates into the mounting hole 6 to reach the inside of the shoe body 1, the gap formed between the upper press plate 9 and the lower press plate 10 clamps the surface of the shoe body 1, and the gap formed between the upper press plate 9 and the lower press plate 10 is further reduced by the press cake 18 mounted between the upper press plate 9 and the lower press plate 10, thereby achieving the function of a compression space, increasing the pressure caused to the surface of the shoe body 1 between the upper press plate 9 and the lower press plate 10, and increasing the clamping force and reducing the possibility of the connecting rod 5 disengaging from the mounting hole 6.

The surfaces of the upper press plate 9 and the lower press plate 10 are both provided with a diversion trench 33 for assisting in drainage, the diversion trenches 33 are linearly arranged on the outer side faces of the upper press plate 9 and the lower press plate 10, and the two adjacent diversion trenches 33 are equidistantly arranged therebetween; when a liquid adheres to the surfaces of the upper press plate 9 or the lower press plate 10, the diversion trenches 33 serve the function of guiding the liquid so as to facilitate the liquid to drain out of the surfaces of the upper press plate 9 or the lower press plate 10, so as to reduce the time for the liquid to stagnate on the surfaces of the upper press plate 9 or the lower press plate 10, and reduce the phenomena that the liquid stagnates for too long and causes corrosion on the surfaces of the upper press plate 9 or the lower press plate 10.

One end of the shoe body 1 is a limiting block 20 for defining the position of an ankle; a movable sling 21 is connected to the surface of the shoe body 1; the movable sling 21 is rotatably mounted to the surface of the shoe body 1; the movable sling 21 plays the role of tightening the shoe body 1; the surface of the movable sling 21 is provided with anti-skid stripe 22; one end of the sole plate 7 is provided with a cushioning pad 23 for cushioning the impact force; the surface of the shoe body 1 is provided with several drainage grooves 24 for assisting in the drainage; when the interior of the shoe body 1 permeates liquid, the liquid is discharged to the exterior of the shoe body 1 through the drainage grooves 24; the anti-skid stripe 22 serves to increase a contact point between the surface of the movable sling 21 and the user's hand, thereby serving to increase a frictional force to reduce slippage of the user's hand on the surface of the movable sling 21.

A cover plate 25 is mounted at one end of the protective housing 2, the cover plate 25 is used for protecting a battery mounted inside the protective housing 2, the type of the battery is a button battery, a movable rotating shaft 26 is connected to one end of the cover plate 25, and the cover plate 25 can move along the surface of the protective housing 2 via the movable rotating shaft 26;

when an acting force is applied to the cover plate 25, the cover plate 25 rotates along the surface of the protective housing 2 via a movable rotating shaft 26, so that a user can put a battery into the interior of the protective housing 2, enabling the main control circuit board 4 to continuously supply power to the wick 3; one end of the protective housing 2 is a protective plate 27, and the protective plate 27 is symmetrically mounted at two ends of the protective housing 2; the wick 3 is located between two adjacent protective plates 27, and the protective plate 27 is used for protecting the wick 3.

A connecting hole 28 is provided on the surface of the protective plate 27, a cushioning rubber block 29 is connected to the inner surface of the connecting hole 28, the cushioning rubber block 29 abuts the surface of the protective plate 27 via the connecting hole 28, the cushioning rubber block 29 is used for cushioning the impact force so as to have the effect of protecting the surface of the protective plate 27, one end of the protective plate 27 is provided with a frosted layer 30 for increasing the frictional force, and the frosted layer 30 is used for increasing the contact area between the surface of the protective plate 27 and the hand of the user so as to play the role of increasing the frictional force, achieve the effect of reducing the sliding of the hand of the user on the surface of the protective plate 27, and facilitate the user to conveniently mount or disassemble the protective plate 27;

a through-hole 31 is provided on the surface of the main control circuit board 4, the through-hole 31 is rectangularly distributed on the surface of the main control circuit board 4, the through-hole 31 is used for connecting an external screw, a locking force is generated by the external screw to enable the main control circuit board 4 to be mounted inside the protective housing 2, an anti-skid groove 32 is provided on the surface of the protective housing 2, and the anti-skid groove 32 is used for increasing the contact point between the surface of the protective housing 2 and the user's hand, thereby playing the role of increasing frictional force and achieving the effect of reducing the sliding of the user's hand on the surface of the protective housing 2.

This embodiment focuses on: using an ever-bright lighting module 11 to emit light for irradiation, thereby extending the lighting time. When the switching button 14 makes contact with one end of the main control circuit board 4, one end of the switching button 14 makes contact with the surface of the contact conductor 16, and the main control circuit board 4 forms a loop with the ever-bright lighting module 11 and the power line 8, so that the ever-bright lighting module 11 is powered on for operation to achieve the effect of ever-bright lighting; therefore, a loop is formed to switch the mode in the lighting module structure.

Embodiment 2

In this embodiment, with reference to FIGS. 1-7, a specifically implemented lighting assembly comprises a shoe body 1 and a lighting structure. The lighting structure comprises a protective housing 2, a wick 3, and a main control circuit board 4. The main control circuit board 4 is mounted inside the protective housing 2, the wick 3 and the main control circuit board 4 are electrically connected, a power line 8 is provided on the surface of the main control circuit board 4, a connecting rod 5 is mounted to one end of the protective housing 2, a mounting hole 6 matchingly mounted with the connecting rod 5 is provided on the surface of the shoe body 1, the mounting hole 6 and the protective housing 2 are of a detachable structure, and the mounting hole 6 is in a curved array on the surface of the shoe body 1. One end of the mounting hole 6 penetrates through the middle of the shoe body 1 and extends towards the interior of the shoe body 1, the bottom of the shoe body 1 is a sole plate 7, and the mounting hole 6 extends between the shoe body 1 and the sole plate 7.

The surface of the main control circuit board 4 is mounted with a lighting module structure for switching the modes of ever-bright lighting, flickering lighting, low-speed flickering lighting, or lighting; the surface of the connecting rod 5 is provided with a limiting assembly matched with the mounting hole 6; the limiting assembly comprises an upper press plate 9 and a lower press plate 10; one end of the protective housing 2 is mounted with a switching button 14 for switching modes; the switching button 14 is electrically connected to the main control circuit board 4.

The lighting module structure comprises a flickering lighting assembly. The flickering lighting assembly is composed of a flickering lighting module 12, one end of the flickering lighting module 12 abuts against one end of the power line 8, the flickering lighting module 12 is electrically connected to the main control circuit board 4, and when the switching button 14 is in contact with one end of the main control circuit board 4, a loop is formed by the main control circuit board 4 and the flickering lighting module 12 and the power line 8, so that the flickering lighting module 12 is powered on to operate, thereby achieving the effect of flickering lighting.

The outside of the switching button 14 is provided with a protective flexible glue 15, and a contact conductor 16 is connected to the surface of the main control circuit board 4; the contact conductor 16 is in contact with one end of the power line 8; the power line 8 is used for connecting to the lighting module structure; when one end of the switching button 14 is in contact with the surface of the contact conductor 16, a loop is formed so as to switch the mode of flickering lighting in the lighting module structure; the mode of flickering lighting is powered on via the power line 8.

The upper press plate 9 and the lower press plate 10 are symmetrically mounted to the surface of the connecting rod 5 in the structure, one end of the upper press plate 9 and one end of the lower press plate 10 are both arc-shaped, the surfaces of the upper press plate 9 and the lower press plate 10 are both provided with a mounting groove 17, the inner surface of the mounting groove 17 is connected with a press cake 18 for increasing the connection stability, the middle part of the press cake 18 is provided with a press groove 19, the press cake 18 is in concave-shaped, one end of the press cake 18 is higher than the inner surface of the mounting groove 17 and extends beyond the surface of the upper press plate 9 or the lower press plate 10, and the outer side face of the press cake 18 is used for fitting with the inner surface of the press groove 19;

when the connecting rod 5 penetrates into the mounting hole 6 to reach the inside of the shoe body 1, the gap formed between the upper press plate 9 and the lower press plate 10 clamps the surface of the shoe body 1, and the gap formed between the upper press plate 9 and the lower press plate 10 is further reduced by the press cake 18 mounted between the upper press plate 9 and the lower press plate 10, thereby achieving the function of a compression space, increasing the pressure caused to the surface of the shoe body 1 between the upper press plate 9 and the lower press plate 10, and increasing the clamping force and reducing the possibility of the connecting rod 5 disengaging from the mounting hole 6.

The surfaces of the upper press plate 9 and the lower press plate 10 are both provided with a diversion trench 33 for assisting in drainage, the diversion trenches 33 are linearly arranged on the outer side faces of the upper press plate 9 and the lower press plate 10, and the two adjacent diversion trenches 33 are equidistantly arranged therebetween; when a liquid adheres to the surfaces of the upper press plate 9 or the lower press plate 10, the diversion trenches 33 serve the function of guiding the liquid so as to facilitate the liquid to drain out of the surfaces of the upper press plate 9 or the lower press plate 10, so as to reduce the time for the liquid to stagnate on the surfaces of the upper press plate 9 or the lower press plate 10, and reduce the phenomena that the liquid stagnates for too long and causes corrosion on the surfaces of the upper press plate 9 or the lower press plate 10.

One end of the shoe body 1 is a limiting block 20 for defining the position of an ankle; a movable sling 21 is connected to the surface of the shoe body 1; the movable sling 21 is rotatably mounted to the surface of the shoe body 1; the movable sling 21 plays the role of tightening the shoe body 1; the surface of the movable sling 21 is provided with anti-skid stripe 22; one end of the sole plate 7 is provided with a cushioning pad 23 for cushioning the impact force; the surface of the shoe body 1 is provided with several drainage grooves 24 for assisting in the drainage; when the interior of the shoe body 1 permeates liquid, the liquid is discharged to the exterior of the shoe body 1 through the drainage grooves 24; the anti-skid stripe 22 serves to increase a contact point between the surface of the movable sling 21 and the user's hand, thereby serving to increase a frictional force to reduce slippage of the user's hand on the surface of the movable sling 21.

A cover plate 25 is mounted at one end of the protective housing 2, the cover plate 25 is used for protecting a battery mounted inside the protective housing 2, the type of the battery is a button battery, a movable rotating shaft 26 is connected to one end of the cover plate 25, and the cover plate 25 can move along the surface of the protective housing 2 via the movable rotating shaft 26;

when an acting force is applied to the cover plate 25, the cover plate 25 rotates along the surface of the protective housing 2 via a movable rotating shaft 26, so that a user can put a battery into the interior of the protective housing 2, enabling the main control circuit board 4 to continuously supply power to the wick 3; one end of the protective housing 2 is a protective plate 27, and the protective plate 27 is symmetrically mounted at two ends of the protective housing 2; the wick 3 is located between two adjacent protective plates 27, and the protective plate 27 is used for protecting the wick 3.

A connecting hole 28 is provided on the surface of the protective plate 27, a cushioning rubber block 29 is connected to the inner surface of the connecting hole 28, the cushioning rubber block 29 abuts the surface of the protective plate 27 via the connecting hole 28, the cushioning rubber block 29 is used for cushioning the impact force so as to have the effect of protecting the surface of the protective plate 27, one end of the protective plate 27 is provided with a frosted layer 30 for increasing the frictional force, and the frosted layer 30 is used for increasing the contact area between the surface of the protective plate 27 and the hand of the user so as to play the role of increasing the frictional force, achieve the effect of reducing the sliding of the hand of the user on the surface of the protective plate 27, and facilitate the user to conveniently mount or disassemble the protective plate 27;

a through-hole 31 is provided on the surface of the main control circuit board 4, the through-hole 31 is rectangularly distributed on the surface of the main control circuit board 4, the through-hole 31 is used for connecting an external screw, a locking force is generated by the external screw to enable the main control circuit board 4 to be mounted inside the protective housing 2, an anti-skid groove 32 is provided on the surface of the protective housing 2, and the anti-skid groove 32 is used for increasing the contact point between the surface of the protective housing 2 and the user's hand, thereby playing the role of increasing frictional force and achieving the effect of reducing the sliding of the user's hand on the surface of the protective housing 2.

This embodiment focuses on: using the flickering lighting module 12 to emit light for irradiation, thereby increasing the visibility of the light irradiation. One end of the flickering lighting module 12 abuts one end of the power line 8; the flickering lighting module 12 is electrically connected to the main control circuit board 4; when the switching button 14 is in contact with one end of the main control circuit board 4, one end of the switching button 14 is in contact with the surface of the contact conductor 16; the main control circuit board 4 forms a loop with the flickering lighting module 12 and the power line 8, so that the flickering lighting module 12 is powered on for operation to achieve the effect of flickering lighting; therefore, a loop is formed to switch the mode of flickering lighting in the lighting module structure.

Embodiment 3

In this embodiment, with reference to FIGS. 1-7, a specifically implemented lighting assembly comprises a shoe body 1 and a lighting structure. The lighting structure comprises a protective housing 2, a wick 3, and a main control circuit board 4. The main control circuit board 4 is mounted inside the protective housing 2, the wick 3 and the main control circuit board 4 are electrically connected, a power line 8 is provided on the surface of the main control circuit board 4, a connecting rod 5 is mounted to one end of the protective housing 2, a mounting hole 6 matchingly mounted with the connecting rod 5 is provided on the surface of the shoe body 1, the mounting hole 6 and the protective housing 2 are of a detachable structure, and the mounting hole 6 is in a curved array on the surface of the shoe body 1. One end of the mounting hole 6 penetrates through the middle of the shoe body 1 and extends towards the interior of the shoe body 1, the bottom of the shoe body 1 is a sole plate 7, and the mounting hole 6 extends between the shoe body 1 and the sole plate 7.

The surface of the main control circuit board 4 is mounted with a lighting module structure for switching the modes of ever-bright lighting, flickering lighting, low-speed flickering lighting, or projection; the surface of the connecting rod 5 is provided with a limiting assembly matched with the mounting hole 6; the limiting assembly comprises an upper press plate 9 and a lower press plate 10; one end of the protective housing 2 is mounted with a switching button 14 for switching modes; the switching button 14 is electrically connected to the main control circuit board 4.

The lighting module structure comprises a low-speed flickering lighting assembly. The low-speed flickering lighting is composed of a low-speed flickering lighting module 13, one end of the low-speed flickering lighting module 13 abuts against one end of the power line 8, the low-speed flickering lighting module 13 is electrically connected to the main control circuit board 4, and when the switching button 14 is in contact with one end of the main control circuit board 4, a loop is formed by the main control circuit board 4 and the low-speed flickering lighting module 13 and the power line 8, so that the low-speed flickering lighting module 13 is powered on to operate, thereby achieving the effect of low-speed flickering lighting. In addition, the lighting module structure comprises a projection assembly. The projection assembly is composed of a projection module and projects to the outside, and at this moment, the projection module is electrically connected to the main control circuit board 4. Optionally, the lighting module structure comprises a sound box assembly or a Bluetooth module, playing music based on the sound box assembly and performing a Bluetooth connection based on the Bluetooth module.

The outside of the switching button 14 is provided with a protective flexible glue 15, and a contact conductor 16 is connected to the surface of the main control circuit board 4; the contact conductor 16 is in contact with one end of the power line 8; the power line 8 is used for connecting to the lighting module structure; when one end of the switching button 14 is in contact with the surface of the contact conductor 16, a loop is formed so as to switch the mode of low-speed flickering lighting in the lighting module structure; the mode of low-speed flickering lighting is powered on via the power line 8.

The upper press plate 9 and the lower press plate 10 are symmetrically mounted to the surface of the connecting rod 5 in the structure, one end of the upper press plate 9 and one end of the lower press plate 10 are both arc-shaped, the surfaces of the upper press plate 9 and the lower press plate 10 are both provided with a mounting groove 17, the inner surface of the mounting groove 17 is connected with a press cake 18 for increasing the connection stability, the middle part of the press cake 18 is provided with a press groove 19, the press cake 18 is in concave-shaped, one end of the press cake 18 is higher than the inner surface of the mounting groove 17 and extends beyond the surface of the upper press plate 9 or the lower press plate 10, and the outer side face of the press cake 18 is used for fitting with the inner surface of the press groove 19;

when the connecting rod 5 penetrates into the mounting hole 6 to reach the inside of the shoe body 1, the gap formed between the upper press plate 9 and the lower press plate 10 clamps the surface of the shoe body 1, and the gap formed between the upper press plate 9 and the lower press plate 10 is further reduced by the press cake 18 mounted between the upper press plate 9 and the lower press plate 10, thereby achieving the function of a compression space, increasing the pressure caused to the surface of the shoe body 1 between the upper press plate 9 and the lower press plate 10, and increasing the clamping force and reducing the possibility of the connecting rod 5 disengaging from the mounting hole 6.

The surfaces of the upper press plate 9 and the lower press plate 10 are both provided with a diversion trench 33 for assisting in drainage, the diversion trenches 33 are linearly arranged on the outer side faces of the upper press plate 9 and the lower press plate 10, and the two adjacent diversion trenches 33 are equidistantly arranged therebetween; when a liquid adheres to the surfaces of the upper press plate 9 or the lower press plate 10, the diversion trenches 33 serve the function of guiding the liquid so as to facilitate the liquid to drain out of the surfaces of the upper press plate 9 or the lower press plate 10, so as to reduce the time for the liquid to stagnate on the surfaces of the upper press plate 9 or the lower press plate 10, and reduce the phenomena that the liquid stagnates for too long and causes corrosion on the surfaces of the upper press plate 9 or the lower press plate 10.

One end of the shoe body 1 is a limiting block 20 for defining the position of an ankle; a movable sling 21 is connected to the surface of the shoe body 1; the movable sling 21 is rotatably mounted to the surface of the shoe body 1; the movable sling 21 plays the role of tightening the shoe body 1; the surface of the movable sling 21 is provided with anti-skid stripe 22; one end of the sole plate 7 is provided with a cushioning pad 23 for cushioning the impact force; the surface of the shoe body 1 is provided with several drainage grooves 24 for assisting in the drainage; when the interior of the shoe body 1 permeates liquid, the liquid is discharged to the exterior of the shoe body 1 through the drainage grooves 24; the anti-skid stripe 22 serves to increase a contact point between the surface of the movable sling 21 and the user's hand, thereby serving to increase a frictional force to reduce slippage of the user's hand on the surface of the movable sling 21.

A cover plate 25 is mounted at one end of the protective housing 2, the cover plate 25 is used for protecting a battery mounted inside the protective housing 2, the type of the battery is a button battery, a movable rotating shaft 26 is connected to one end of the cover plate 25, and the cover plate 25 can move along the surface of the protective housing 2 via the movable rotating shaft 26;

when an acting force is applied to the cover plate 25, the cover plate 25 rotates along the surface of the protective housing 2 via a movable rotating shaft 26, so that a user can put a battery into the interior of the protective housing 2, enabling the main control circuit board 4 to continuously supply power to the wick 3; one end of the protective housing 2 is a protective plate 27, and the protective plate 27 is symmetrically mounted at two ends of the protective housing 2; the wick 3 is located between two adjacent protective plates 27, and the protective plate 27 is used for protecting the wick 3.

A connecting hole 28 is provided on the surface of the protective plate 27, a cushioning rubber block 29 is connected to the inner surface of the connecting hole 28, the cushioning rubber block 29 abuts the surface of the protective plate 27 via the connecting hole 28, the cushioning rubber block 29 is used for cushioning the impact force so as to have the effect of protecting the surface of the protective plate 27, one end of the protective plate 27 is provided with a frosted layer 30 for increasing the frictional force, and the frosted layer 30 is used for increasing the contact area between the surface of the protective plate 27 and the hand of the user so as to play the role of increasing the frictional force, achieve the effect of reducing the sliding of the hand of the user on the surface of the protective plate 27, and facilitate the user to conveniently mount or disassemble the protective plate 27;

a through-hole 31 is provided on the surface of the main control circuit board 4, the through-hole 31 is rectangularly distributed on the surface of the main control circuit board 4, the through-hole 31 is used for connecting an external screw, a locking force is generated by the external screw to enable the main control circuit board 4 to be mounted inside the protective housing 2, an anti-skid groove 32 is provided on the surface of the protective housing 2, and the anti-skid groove 32 is used for increasing the contact point between the surface of the protective housing 2 and the user's hand, thereby playing the role of increasing frictional force and achieving the effect of reducing the sliding of the user's hand on the surface of the protective housing 2.

This embodiment focuses on: using a low-speed flickering lighting module 13 to emit light for irradiation, thereby reducing the speed of power consumption and playing the role of increasing the photon duration. One end of the low-speed flickering lighting module 13 abuts against one end of the power line 8; the low-speed flickering lighting module 13 is electrically connected to the main control circuit board 4; when the switching button 14 is in contact with one end of the main control circuit board 4, one end of the switching button 14 is in contact with the surface of the contact conductor 16; the main control circuit board 4 forms a loop with the low-speed flickering lighting module 13 and the power line 8, so that the low-speed flickering lighting module 13 is powered on for operation to achieve the effect of low-speed flickering lighting; therefore, a loop is formed to switch the mode of low-speed flickering lighting in the lighting module structure.

The above content is a further detailed description of the present disclosure in combination with specific preferred embodiments. It cannot be determined that the specific implementation of the disclosure is limited to these descriptions. For ordinary technicians in the technical field to which the disclosure belongs, they can also make several simple deductions or replacements without departing from the concept of the disclosure, which should be considered as the scope of the disclosure.

What is claimed is:

1. A lighting assembly comprising a lighting structure, wherein: the lighting structure comprises a protective housing, a wick, and a main control circuit board, wherein the main control circuit board is mounted inside the protective housing, the wick is electrically connected to the main control circuit board, a power line is provided on a surface of the main control circuit board, and a connecting rod is mounted to one end of the protective housing;

the surface of the main control circuit board is mounted with a lighting module structure for switching modes of ever-bright lighting, flickering lighting, low-speed flickering lighting, or projection, one end of the protective housing is mounted with a switching button for switching modes, and the switching button is electrically connected to the main control circuit board;

wherein a cover plate is mounted to one end of the protective housing, the cover plate is used for protecting a battery mounted inside the protective housing, a movable rotating shaft is connected to one end of the cover plate such that the cover plate can move along a surface of the protective housing via the movable rotating shaft.

2. The lighting assembly according to claim 1, wherein: the lighting module structure comprises ever-bright lighting assembly, wherein the ever-bright lighting assembly is composed of an ever-bright lighting module, one end of the ever-bright lighting module abuts against one end of the power line, and the ever-bright lighting module is electrically connected to the main control circuit board.

3. The lighting assembly according to claim 1, wherein: the lighting module structure comprises a flickering lighting assembly, wherein the flickering lighting assembly is composed of a flickering lighting module, one end of the flickering lighting module abuts against one end of the power line, and the flickering lighting module is electrically connected to the main control circuit board.

4. The lighting assembly according to claim 1, wherein: the lighting module structure comprises low-speed flickering lighting assembly, wherein the low-speed flickering lighting is composed of a low-speed flickering lighting module, one end of the low-speed flickering lighting module abuts against one end of the power line, and the low-speed flickering lighting module is electrically connected to the main control circuit board.

5. The lighting assembly according to claim 4, wherein: a protective flexible glue is provided on an outside of the switching button, a contact conductor is connected to the surface of the main control circuit board, the contact conductor abuts against one end of the power line, and the power line is used for connecting to the lighting module structure.

6. The lighting assembly according to claim 1, wherein: the lighting assembly further comprises a shoe body, a surface of the shoe body is provided with a mounting hole matchingly mounted with the connecting rod, the mounting hole and the protective housing are of a detachable structure, the mounting hole is in a curved array on the surface of the shoe body, one end of the mounting hole penetrates a middle of the shoe body and extends to an inside of the shoe body, a bottom of the shoe body is a sole plate, a surface of the connecting rod is provided with a limiting assembly for matching with the mounting hole, and the limiting assembly comprises an upper press plate and a lower press plate.

7. The lighting assembly according to claim 6, wherein: the upper press plate and the lower press plate are symmetrically mounted to the surface of the connecting rod, one end of the upper press plate and one end of the lower press plate are both arc-shaped, surfaces of the upper press plate and the lower press plate are both provided with a mounting groove, an inner surface of the mounting groove is connected with a press cake for increasing connection stability, a middle of the press cake is provided with a press groove, the press cake is concave-shaped, and one end of the press cake is higher than the inner surface of the mounting groove and extends beyond the surface of the upper press plate or the lower press plate; the surfaces of the upper press plate and the lower press plate are both provided with diversion trenches for assisting in drainage, the diversion trenches are linearly arranged on outer side faces of the upper press plate and the lower press plate, and two adjacent diversion trenches are equidistantly arranged therebetween.

8. The lighting assembly according to claim 7, wherein: one end of the shoe body is a limiting block for defining a position of an ankle, a movable sling is connected to the surface of the shoe body, the movable sling is rotatably mounted to the surface of the shoe body, the surface of the movable sling is provided with an anti-skid stripe, one end of the sole plate is provided with a cushioning pad for cushioning an impact force, and the surface of the shoe body is provided with several drainage grooves for assisting in drainage.

9. The lighting assembly according to claim 1, wherein: one end of the protective housing is a protective plate, a protective plate structure is symmetrically mounted to two ends of the protective housing, and the wick is located between two adjacent protective plates.

10. The lighting assembly according to claim 9, wherein the surface of the protective plate is provided with a connecting hole, an inner surface of the connecting hole is connected with a cushioning rubber block, one end of the protective plate is provided with a frosted layer for increasing frictional force, the surface of the main control circuit board is provided with a through-hole, the through-hole is rectangularly distributed on the surface of the main control circuit board, and the surface of the protective housing is provided with an anti-skid groove.

* * * * *